US009597258B2

(12) United States Patent
Force et al.

(10) Patent No.: US 9,597,258 B2
(45) Date of Patent: Mar. 21, 2017

(54) PRESSURIZED MANIFOLD AND JET SYSTEM FOR A SPA

(71) Applicants: Ryan Force, Nescopeck, PA (US); Chris Fetter, Middleburg, PA (US)

(72) Inventors: Ryan Force, Nescopeck, PA (US); Chris Fetter, Middleburg, PA (US)

(73) Assignee: STRONG INDUSTRIES, INC., Northumberland, PA (US)

( * ) Notice: Subject to any disclaimer, the term of this patent is extended or adjusted under 35 U.S.C. 154(b) by 236 days.

(21) Appl. No.: 14/230,643

(22) Filed: Mar. 31, 2014

(65) Prior Publication Data

US 2015/0272823 A1 Oct. 1, 2015

(51) Int. Cl.
*A61H 33/00* (2006.01)

(52) U.S. Cl.
CPC ..... *A61H 33/6063* (2013.01)

(58) Field of Classification Search
CPC ..... A61H 33/6063
USPC ..... 4/541.6
See application file for complete search history.

(56) References Cited

U.S. PATENT DOCUMENTS

2005/0050627 A1* 3/2005 Ayeni ..... A61H 33/60 4/541.6
2007/0289057 A1* 12/2007 Ludlow ..... A61H 33/02 4/541.6

* cited by examiner

*Primary Examiner* — Janie Loeppke
(74) *Attorney, Agent, or Firm* — Grogan, Tuccillo & Vanderleeden, LLP

(57) ABSTRACT

A spa according to the present invention includes a shell having a plurality of seating positions formed in the shell, a base supporting the shell, and a hydrotherapy system configured to draw a fluid from the spa and inject the fluid back into said spa as at least one a pressurized jet. The hydrotherapy system includes a pump for circulating the fluid and a jet pod arranged in at least one of the seating positions and in fluid communication with the pump.

6 Claims, 9 Drawing Sheets

PRESSURIZED MANIFOLD AND JET SYSTEM FOR A SPA

FIELD OF THE INVENTION

The present invention relates generally to spas and, more particularly, to pressurized manifold and jet system for a spa.

BACKGROUND OF THE INVENTION

Spas, also commonly known as hot tubs, are generally deep vacuum formed tubs having a smooth acrylic interior surface or liner. The tubs are provided with a number of fixtures including water jet assemblies that provide hydrotherapy to users of the spa when the spa is filled with water.

Spas are typically manufactured by heating an acrylic sheet to a forming temperature, stretching the sheet onto a mold, and holding the sheet against the mold by applying a vacuum between the mold surface and the sheet. After forming the acrylic liner, holes are then manually cut through the liner for various components including the water jets. A typical spa may include anywhere from 30-120 or more water jets, and construction of the spa requires cutting 30-120 holes in the acrylic liner to accommodate the jets. Once the cutouts for the jets have been made, jet assemblies must be placed in each cutout, which includes placing a gasket between a wall fitting of the jet assembly and the interior surface of the tub, providing the wall fitting through the cutout, and threading a jet valve body onto the wall fitting from the back of the tub such that the wall fitting and the jet valve body sandwich the tub wall. A bead of caulk is utilized to seal the jet valve body to the back of the tub wall.

FIGS. 1 and 2 illustrate the back of a prior art spa and, in particular, illustrate a plurality of jet assemblies 12 that are mounted in cutouts in the spa liner 14. As shown therein, each jet assembly 12 includes fittings for connecting a water supply line 16 and an air supply line 18 thereto. Each air supply line 18 is connected to a pressurized air source (not shown), and each water supply 16 line is connected to a water manifold 20. In operation, water is drawn from the tub by a pump, passed through a heating element to heat the water to a desired temperature, and delivered to the manifold 20 and supply lines 16 to the jet assemblies 12. Water supplied to the jets 12 is mixed with air from the air supply lines 18 to make the stream from the jets 12 more robust.

Notably, however, spas with this type of circulation system are extremely costly and time consuming to manufacture, and are prone to leaking. In particular, making each cutout and assembling and mounting upwards of 120 jet assemblies by hand is extremely time consuming and tedious and often requires two people. Moreover, each jet assembly, each fitting on each jet assembly for the water and air lines, and each connection to the water manifold is a potential leak point. As will be readily appreciated, this presents upwards of 360 or more possible places in the spa that leaks may occur. Moreover, existing spas are especially leak-prone where metal components are used (due to corrosion).

From a business standpoint, therefore, spas are extremely time consuming and costly to manufacture due to the manual labor necessary to install each individual jet assembly and the dedicated water and air supply lines for each jet. Moreover, repair and warranty costs are often a concern, mostly due to the high number of potential leakage points, as discussed above.

In addition, spas of this type typically require the use of two 5 hp motors to run the pumps that push the water through the circulation system. This requirement stems mainly from the high degree of hydraulic impedance resulting from the many twists and turns of the numerous water supply lines. As will be readily appreciated, therefore, the use of two motors, or a single motor having a higher output, adds additional costs to the spa as a whole.

In view of the above, there remains a need for a jet system for a spa that is less prone to leakage, lowers impedance and decreases overall repair and warranty costs. In addition, there is a need for a jet system for a spa that can be easily customized to provide a desired degree and type of hydrotherapy.

SUMMARY OF THE INVENTION

It is an object of the present invention to provide a jet system for a spa.

It is another object of the present invention to provide a jet system for a spa in the form of a pressurized manifold.

It is another object of the present invention to provide a jet system for a spa having fewer components.

It is another object of the present invention to provide a jet system for a spa having components that are less prone to corrosion.

It is another object of the present invention to provide a jet system for a spa that is less prone to leakage than existing systems.

It is another object of the present invention to provide a jet system for a spa that lowers hydraulic impedance.

It is another object of the present invention to provide a jet system for a spa that decreases overall repair and warranty costs.

It is another object of the present invention to provide a jet system for a spa that can be easily customized.

In an embodiment, a spa according to the present invention includes a shell having a plurality of seating positions formed in the shell, a base supporting the shell, and a hydrotherapy system configured to draw a fluid from the spa and inject the fluid back into said spa as at least one a pressurized jet. The hydrotherapy system includes a pump for circulating the fluid and a jet pod arranged in at least one of the seating positions and in fluid communication with the pump.

In another embodiment, a spa includes a shell having a plurality of seating positions formed in the shell, a base supporting the shell, and at least one jet pod arranged in each of the seating positions. Each of said jet pods includes a generally hollow body having an inlet configured to accept a supply of water and a plurality of outlet apertures configured to deliver a plurality of streams of pressurized water to an interior of the spa.

In yet another embodiment, a jet pod assembly for a spa is provided. The jet pod assembly includes a generally hollow body defined by a plurality of sidewalls and opposed front and rear walls, an inlet aperture formed in the rear wall, and a plurality of outlet apertures formed in the front wall.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

Figure 1:
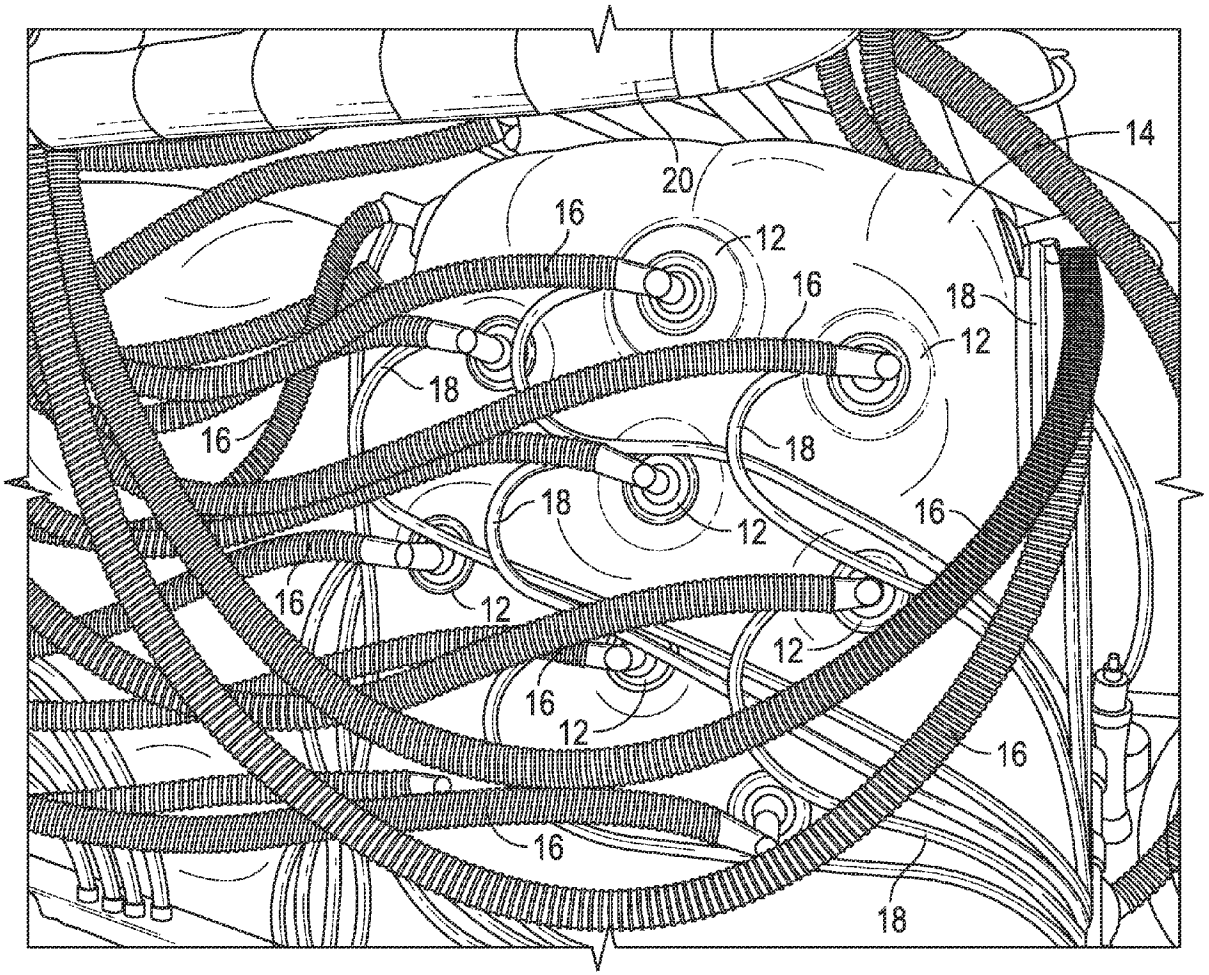
FIG. 1 (Prior Art)
FIG. 1 is a perspective view illustrating a prior art jet system for a spa.
Figure 2:
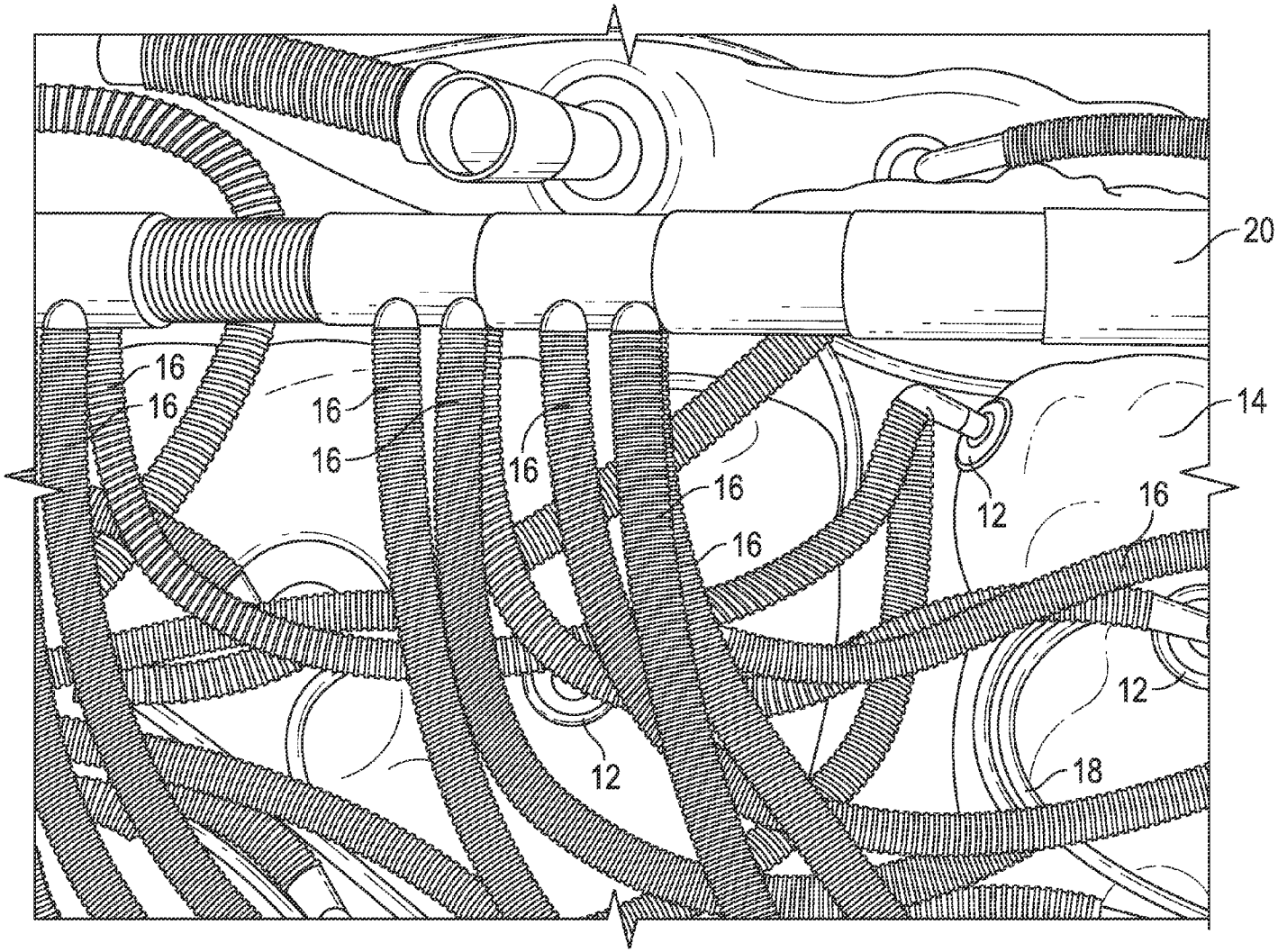
FIG. 2 (Prior Art)
FIG. 2 is another perspective view illustrating the prior art jet system of FIG. 1.
Figure 3:
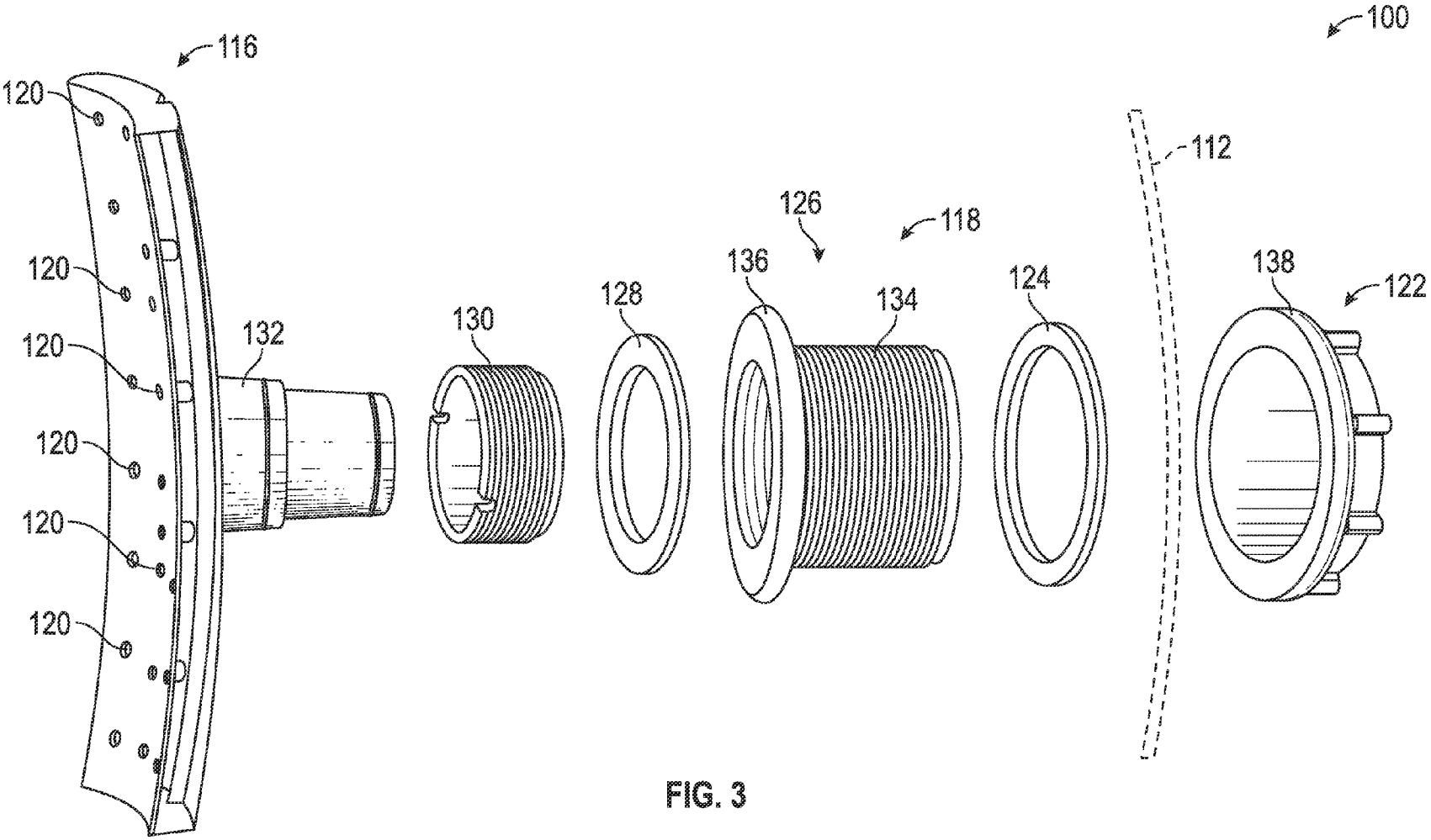
FIG. 3 illustrates a jet system for a spa according to an embodiment of the present invention.
Figure 4:
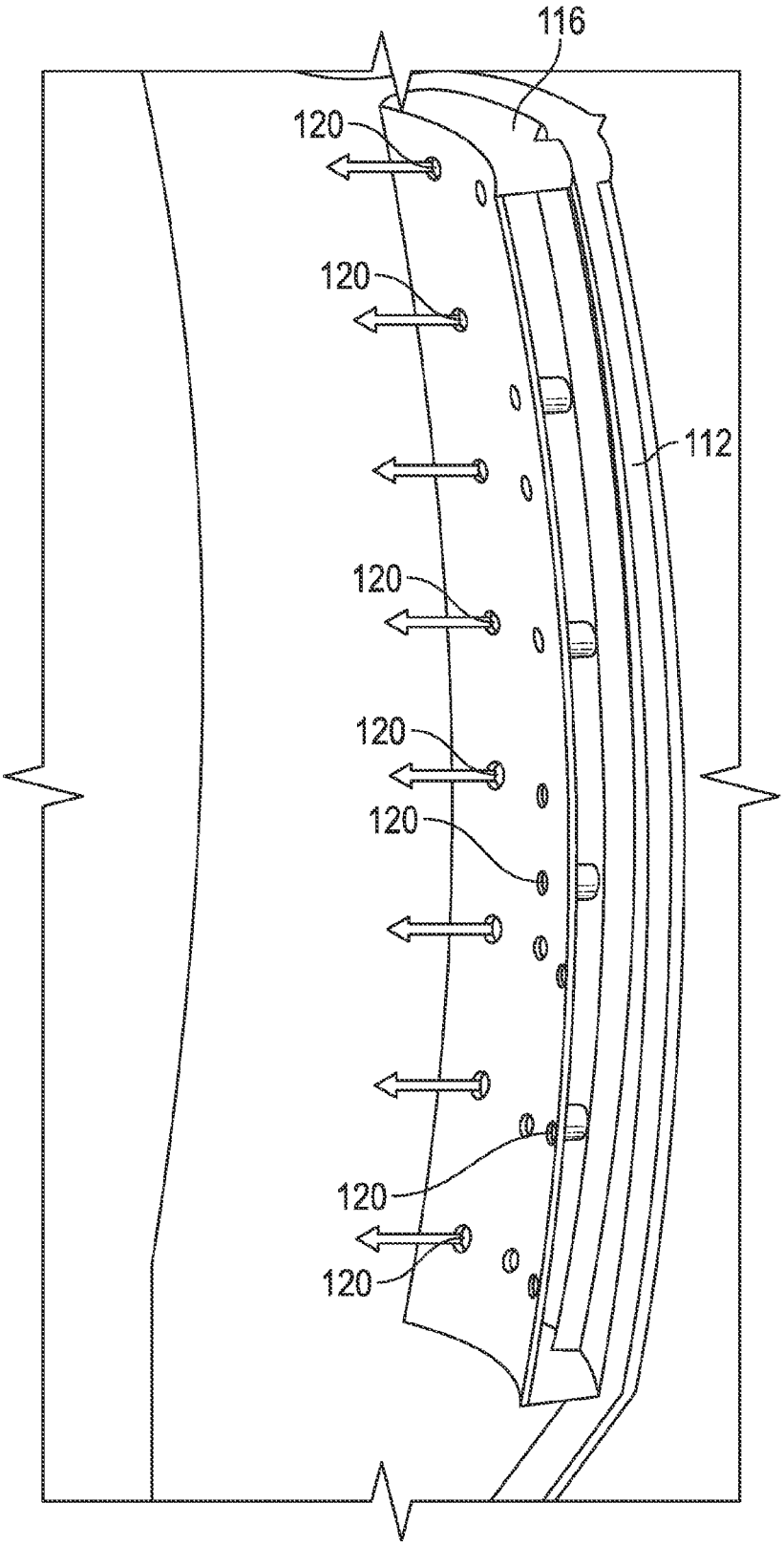
FIG. 4 is a perspective view of a jet pod of the jet system of FIG. 3.
Figure 5:
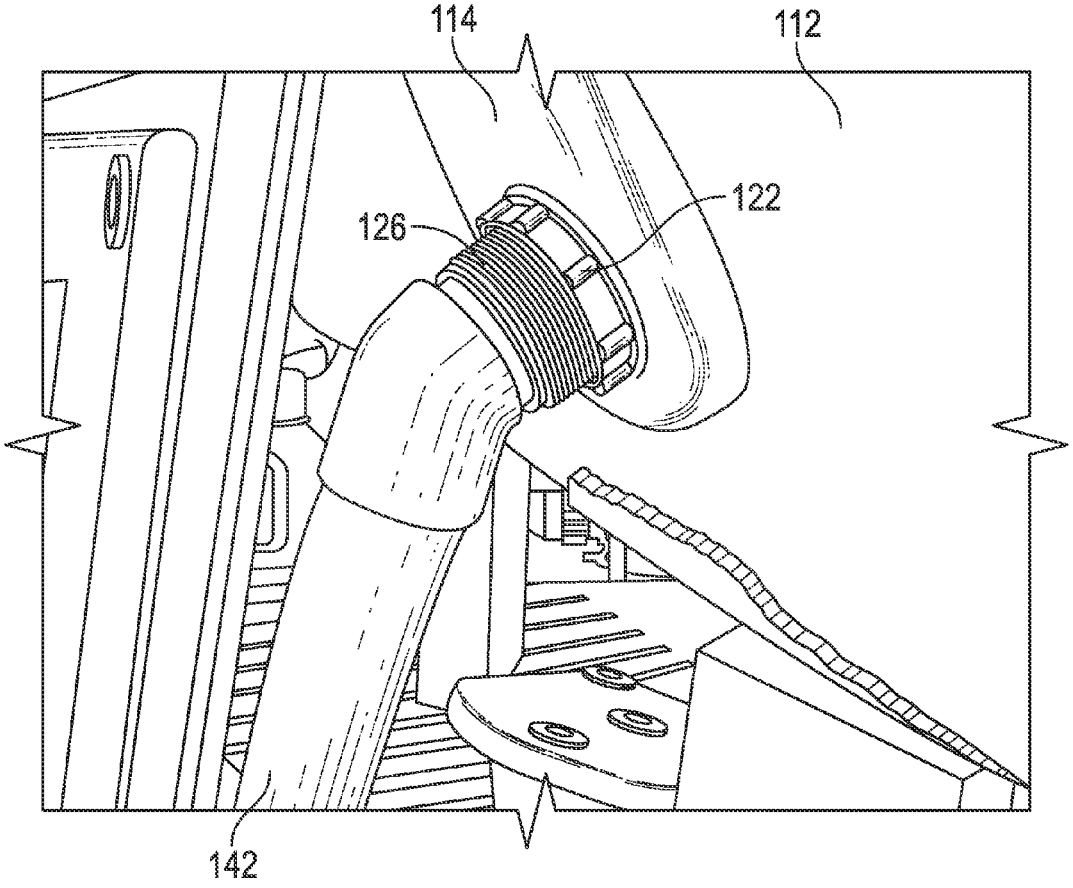
FIG. 5 is a perspective view of a connection between a water supply line and the jet pod of FIG. 4.

Referring to FIGS. 3-5, a spa having a jet system 100 according to an embodiment of the present invention is shown. The spa may be of any type known in the art, and generally includes a base and an acrylic shell 112 supported by the base, as discussed above. Typically, the acrylic shell 112 of the spa is formed into shapes that provide a variety of seating arrangements within the spa. In an embodiment, each seating area within the spa may include a recess 114 for accommodating a jet pod 116 therein. In particular, as best shown in FIG. 5, the acrylic shell 112 may be vacuum formed with interior recessed areas 114 dimensioned to receive a jet pod 116 of the jet system 100 therein.

In an embodiment, the recessed areas 114 may be deep enough to fully accommodate the jet pod 116 therein such that the front face of the jet pod is generally coplanar with the inner surface of the acrylic shell 112. Alternatively, the jet pods 116 may be mounted on stand-offs (not shown) on the inner surface of the shell 112. In an embodiment, each seating area within the spa may include a recess 114 for accommodating a jet pod 116. In other embodiments, each seating area within the spa may include a plurality of recesses 114 for accommodating multiple jet pods 116 therein.

As shown in FIG. 3, the jet pods 116 are secured to the acrylic shell, in position within the recesses 114, utilizing an array of fittings 118, as discussed hereinafter.

With specific reference to FIG. 4, each jet pod 116 is a generally hollow body formed from plastic having a single, large inlet aperture (not shown) on a rear side thereof and an array of small exit apertures 120 on a front side thereof. The jet pods 116 may be formed by rotational molding, although other methods known in the art may also be utilized without departing from the broader aspects of the present invention. While the jet pods 116 are illustrated as being substantially rectangular in shape, the jet pods 116 may be produced in a variety of shapes designed to match the recesses 114 in the shell 112, without departing from the broader aspects of the present invention. Notably, the array of apertures 120 in the front face of the jet pod 116 may take any configuration such that circulated, pressurized water within the pod 116 may be ejected through the apertures 120 to provide hydrotherapy to a user of the spa.

Figure 6:
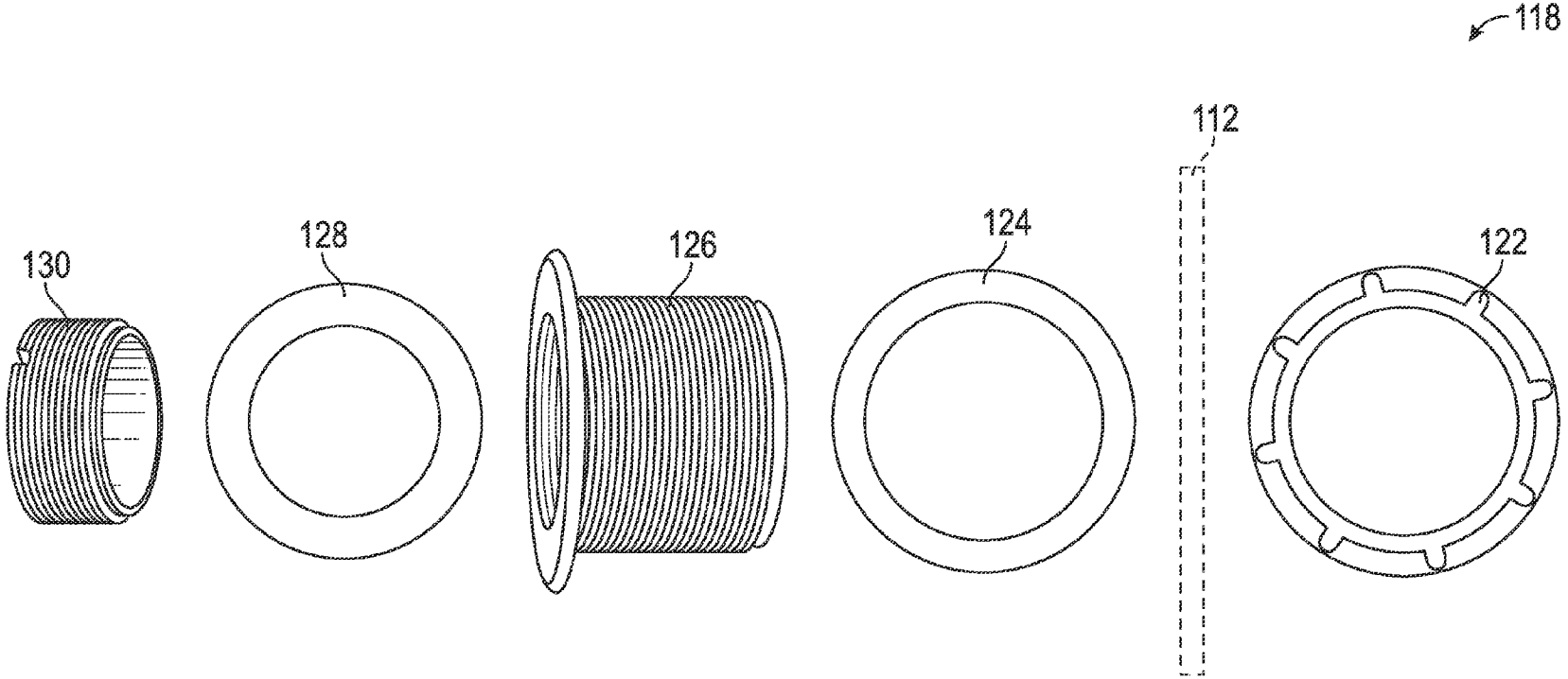
FIG. 6 is an exploded, perspective view of wall fittings of the jet system utilized to connect the jet pod to the water supply line.
Figure 7:
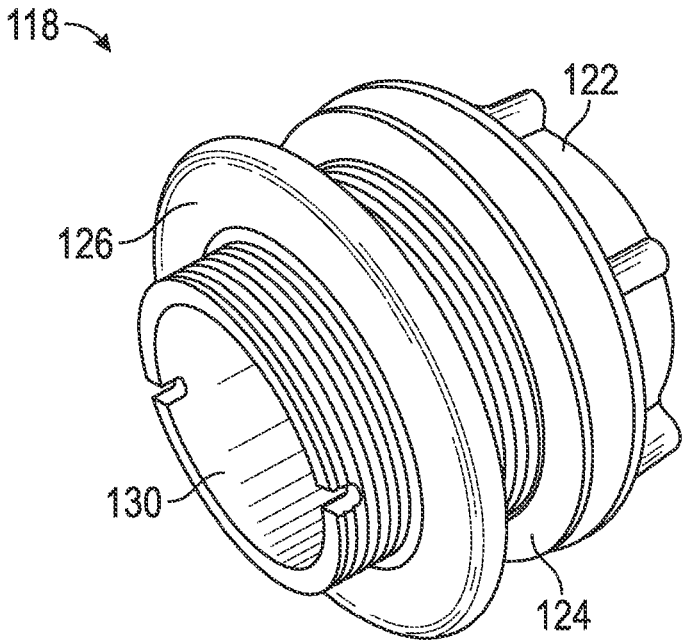
FIG. 7 is a perspective view of the wall fittings of the jet system of FIG. 6, shown in an assembled state.
Figure 8:
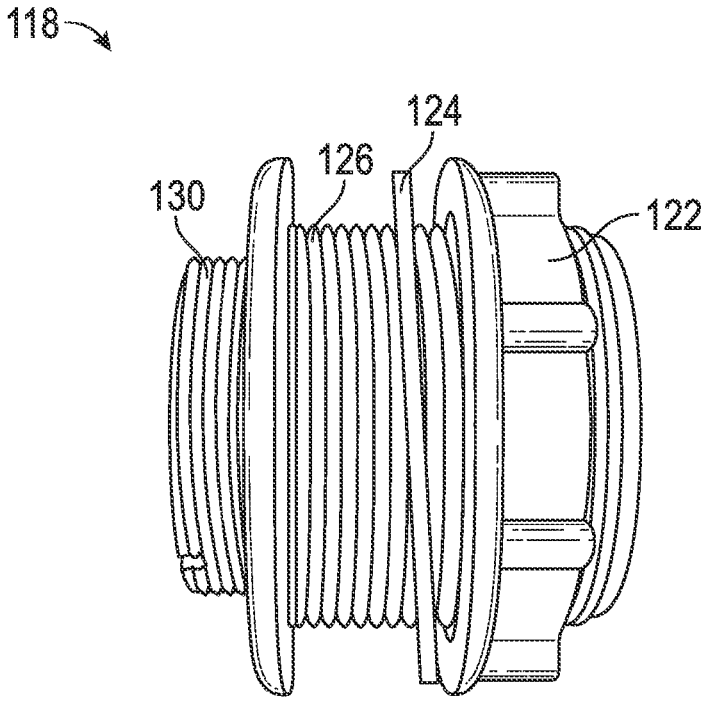
FIG. 8 is another view of the wall fittings of the jet system of FIG. 6, shown in an assembled state.

With further reference to FIG. 3, and with reference to FIGS. 6-8, the integration of the jet pods 116 with the spa will be discussed hereinafter. As noted above, the jet pods 116 are mounted to the shell 112 of the spa within the recessed areas 114 utilizing an array of fittings 118. In particular, the array of fittings include a nut 122, a first gasket 124, a wall fitting 126, a second gasket 128, an inner fitting 130 and a manifold fitting 132. The wall fitting 126 is generally cylindrical in shape and includes an externally threaded body portion 134 and an annular flange 136 formed adjacent to one end of the body portion. The body portion 134 is dimensioned so as be threadedly received by nut 122, and is also internally threaded so as to mate with inner fitting 130, as discussed hereinafter.

Figure 11:
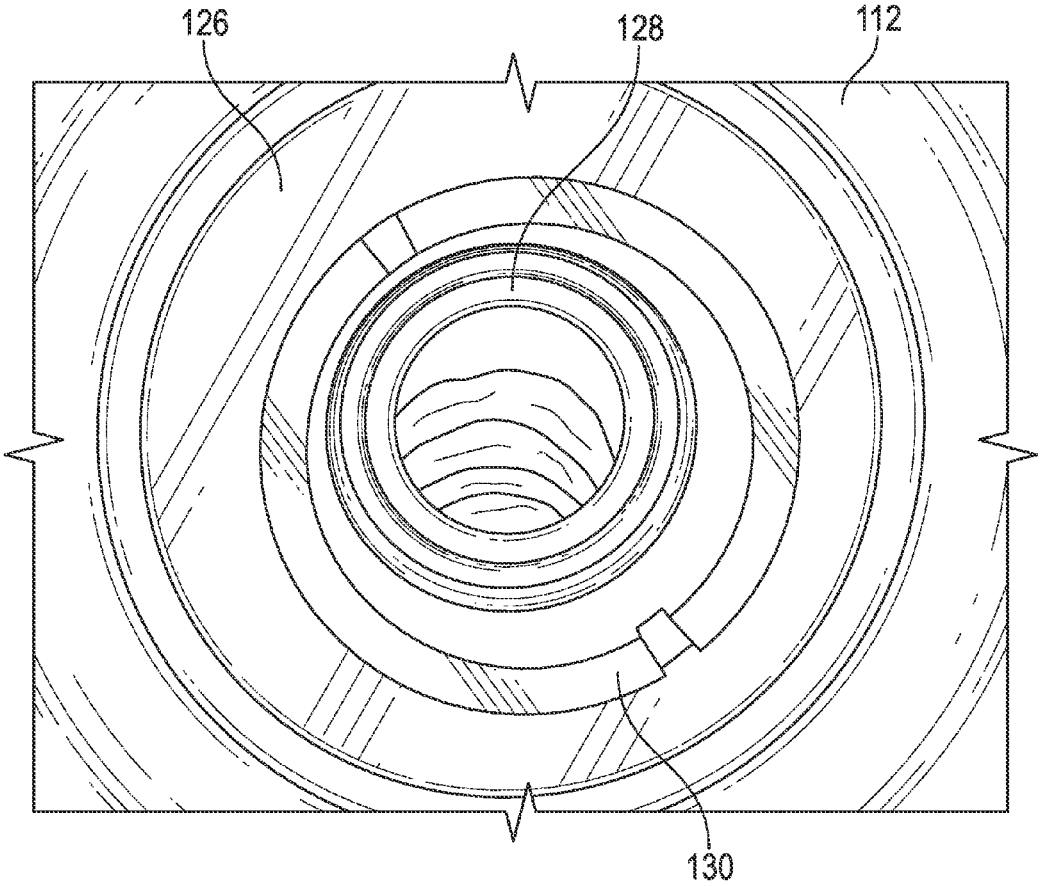
FIG. 11 is an enlarged view of the wall fittings mounted to the shell of a spa.

During installation the first gasket 124 is positioned on the body portion 124 of the wall fitting 126 adjacent the annular flange 136. The body portion 124 is then provided through an aperture in the shell 112 within the recessed area 114 thereof. Nut 122 is then threaded onto the body portion 134 and tightened until the flange 138 of the nut 122 and the flange 136 of the wall fitting 126 sandwich the shell 116 therebetween. FIG. 5 illustrates the wall fitting 126 retained in position within recessed portion 114 of the shell 112 by the nut 122. Prior to or after installing the wall fitting 126, second gasket 128 is inserted into the flange end of the wall fitting 134. Inner fitting 130 is then threaded into the wall fitting 126 adjacent to the flange end thereof to retain the second gasket 130 in place. FIG. 11 shows the second gasket 128 retained in position between the wall fitting 126 and the inner fitting 130. FIGS. 7 and 8 illustrate the assembled position of the array of fittings 118 (the shell 112 of the spa being omitted for illustrative purposes).

Figure 9:
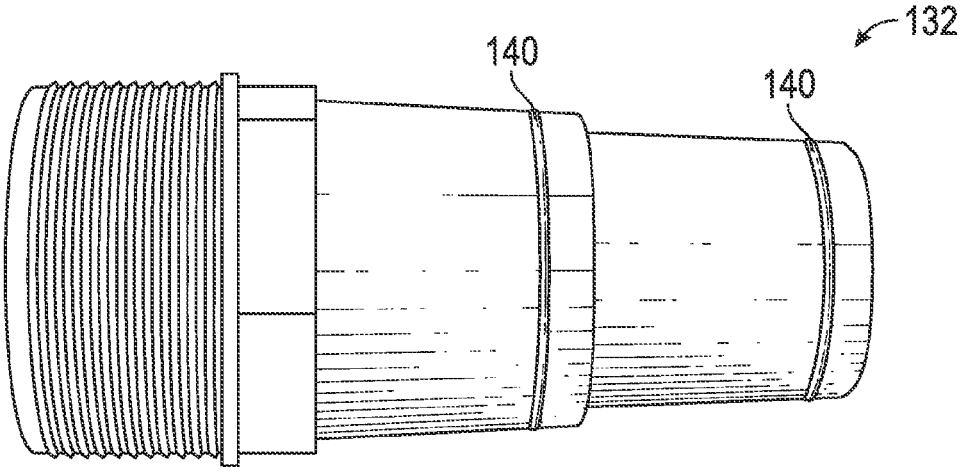
FIG. 9 is a perspective view of a male fitting utilized to connect the jet pod to the wall fittings.

With reference to FIG. 9, a detailed view of the male fitting 132 is shown. As illustrated therein, the male fitting 132 is generally conical in shape and has a plurality of steps. The fitting 132 is externally threaded at one end thereof and is configured to mate with a corresponding threaded aperture in the rear of the jet pod 116 (see FIG. 3). Adjacent to each of the steps is a raised, peripheral ring 140 that functions to retain the male fitting 132 within the wall fitting 126 as described below. After the wall fitting 126, gaskets 124, 128, nut 122 and inner fitting 130 have been secured in place on the spa shell 112, the end of the male fitting 132 is inserted into the inner fitting 130 and wall fitting 126 until one or both of the peripheral rings 140 are urged past the second gasket 128 in the wall fitting 126.

Figure 10:
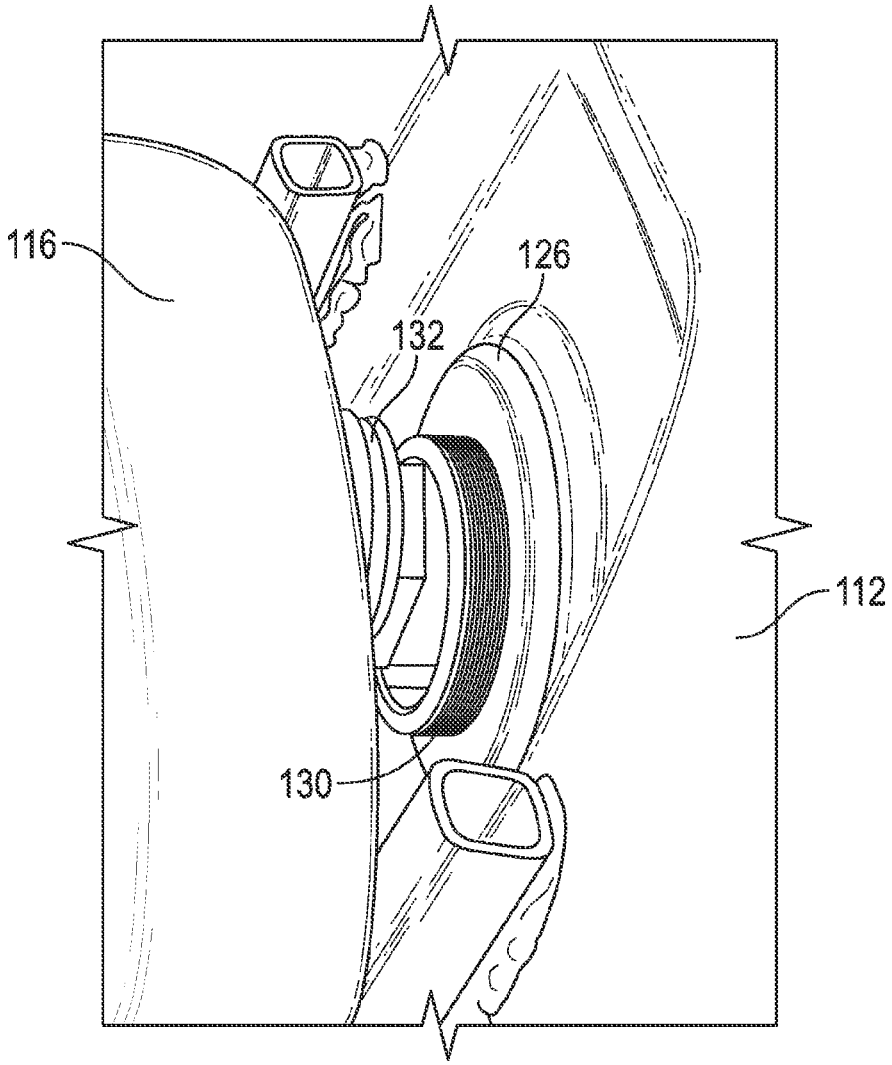
FIG. 10 illustrates the jet pod and wall fittings mounted to the shell of a spa.

Once urged past the gasket 128, the male fitting 132 and the jet pod 116 attached thereto are retained in place, as shown in FIG. 10. In particular, peripheral ring 140, and its engagement with gasket 128, prevents the male fitting 132 (and jet pod 116) from being disengaged from its seated position within the wall fitting 126 when water is circulated. As also shown in FIG. 10, each recess 114 may include a mounting surface or mounting standoffs that are attached with adhesive to the shell 112. The jet pods 116 may then be attached to the mounting standoffs to secure them in place within the recesses 114. Importantly, this manner of attaching the jet pods 116 to the spa shell 116 obviates any need to use mechanical fasteners which may increase the potential for leaks.

Referring once again to FIG. 5, once the jet pods 116 are secured in place within the recesses 114 in the seating positions formed the shell 112 utilizing the array of fittings 118, a water supply line 142 may be connected to each of the wall fittings 126 on the back side of the shell 112.

In an embodiment, the fittings 118 are formed from plastic such as PVC, although other materials known to resist corrosion may also be utilized without departing from the broader aspects of the present invention. In addition, the first and second gaskets 124, 128 are formed from deformable plastic or other deformable material. Importantly, the jet pods 116 themselves and the array of fitting 118 utilized to connected each jet pod 116 to the shell 112 of the spa are manufactured from materials that won't corrode. As will be readily appreciated, this eliminates any potential for leakage due to corrosion of any of the components, thereby decreasing the potential for needed repairs.

In operation, water is drawn from the spa by a pump, passed through a heating element to heat the water to a desired temperature, and delivered to one or more supply manifolds (not shown). The water may then be distributed through the water supply lines 142 to each of the jet pods 116. In an embodiment, the heated water may also be mixed with pressurized air, as is known in the art. In this manner, the heated water flows through the shell 112 of the spa and into the jet pods 116. This creates a pressurized vessel which releases pressure through the apertures 120 in the front face of the jet pods 116, thereby providing hydrotherapy jets of a water that impinge upon the body of a user seated in the spa in one of the seating arrangements.

Importantly, pressurized jet pods 116 produce the same effects as traditional hydrotherapy spa jets but are much less costly and time consuming to install. In particular, the apertures 120 on the front face of the jet pods 116 function in a manner substantially similar to, and take the place of, the numerous individual jets of traditional spas. Instead of manually cutting out apertures and installing numerous individual hydrotherapy jets for each seating arrangement (and up to 120 jets per spa), however, only a single jet pod 116 need be installed for each seating arrangement. As will be readily appreciated, this greatly decreases the labor and time needed to install the jet system for the spa.

Moreover, as there are generally only one or two jet pod assemblies 116 per seating arrangement, there are many less potential leakage points as compared with traditional jet systems having numerous individual jets per seating arrangement. Indeed, while there is generally only one water supply line 142 for each seating arrangement, and thus only a single potential leakage point per seating arrangement, existing hydrotherapy systems have separate water supply lines for each individual jet, and thus a potential leakage point at the connection points between each individual jet and its water supply line. In addition, because the jet pods 116 and fittings 118 are formed from plastic or other corrosion-resistant material, leakage due to corrosion is all but eliminated. As a result, repair and warranty costs over the life of the spa are may be greatly decreased.

In connection with this, because there are fewer water supply lines 142 (due to the fact that there are a limited number of jet pods 116 in each spa), hydraulic impedance is much lower. As a result, a spa employing the jet system of the present invention can be operated utilizing a single motor, or a motor with a lesser output than would be required with traditional spas, thereby decreasing the cost of the spa as a whole.

In addition to the benefits described above, the jet system 100 according to the present invention provides a level of customization heretofore unknown in the art. In particular, the jet pods 116 may be manufactured with different exit aperture configurations that provide varied hydrotherapy experiences for a user. As such, if a user wants a different hydrotherapy experience (e.g., a more pointed application of water pressure, higher pressure, or lower pressure, etc.), the user can simply select a jet pod 116 configured to deliver the desired experience. The jet pod 116 in the seating position may then simply be swapped out for the alternative jet pod simply by disengaging the male fitting 132 (and jet pod 116) from the second gasket 128 and wall fitting 126 and inserting the new jet pod into place. In this manner, changing the hydrotherapy experience at a seating position may be as easy as swapping a single jet pod 116 configured to deliver one hydrotherapy experience for another jet pod 116 configured to deliver another hydrotherapy experience.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A spa, comprising:

a shell having a plurality of seating positions formed in said shell, at least one of said plurality of seating positions including a recess formed therein;

a base supporting said shell;

a hydrotherapy system configured to draw a fluid from said spa and inject said fluid back into said spa as at least one a pressurized jet, said hydrotherapy system including a pump for circulating said fluid and a jet pod arranged in recess and being in fluid communication with said pump; and an array of fittings for releasably securing said jet pod within said recess, said array of fittings including:

a tapered male fitting extending from said jet pod and including a raised annular ring formed on a peripheral surface of said male fitting; and a female wall fitting extending through an aperture in said shell and secured to said shell, said wall fitting including a generally hollow, cylindrical body having an annular gasket positioned within said body;

wherein said tapered male fitting is received within said body of said female wall fitting and extends through said aperture in said shell such that said raised ring of said male fitting is positioned adjacent to an outer surface of said annular gasket; and wherein said raised ring is configured to engage said outer surface of said annular gasket when said fluid is circulated through said spa to retain said male fitting within said female wall fitting;

wherein a front face of said jet pod is generally coplanar with an inner surface of said shell.

2. The spa of claim 1, wherein:

said jet pod is a generally hollow body having an inlet in fluid communication with said pump and an array of outlet apertures.

3. The spa of claim 1, wherein:

no more than one jet pod is arranged within one of said seating positions.

4. The spa of claim 1, wherein:

said array of fittings and said jet pod are formed entirely from plastics.

5. The spa of claim 1, wherein:

said jet pod is rotationally molded.

6. The spa of claim 1, wherein:

each of said seating positions has a jet pod positioned therein.

* * * * *